US006390002B1

(12) United States Patent
Handte et al.

(10) Patent No.: US 6,390,002 B1
(45) Date of Patent: May 21, 2002

(54) SEWING UNIT FOR SEWING FOLDED OR PRE-FOLDED POCKETS

(75) Inventors: Werner Handte, Kaiserslautern; Gerd Helf, Mehlingen; Axel Zinsmeister, Rothselberg, all of (DE)

(73) Assignee: G. M. Pfaff AG (DE)

( * ) Notice: Subject to any disclaimer, the term of this patent is extended or adjusted under 35 U.S.C. 154(b) by 0 days.

(21) Appl. No.: 09/786,948

(22) PCT Filed: Sep. 7, 1999

(86) PCT No.: PCT/EP99/06588

§ 371 Date: Jun. 11, 2001

§ 102(e) Date: Jun. 11, 2001

(87) PCT Pub. No.: WO00/14318

PCT Pub. Date: Mar. 16, 2000

(30) Foreign Application Priority Data

Sep. 8, 1998 (DE) ..... 198 40 749

(51) Int. Cl.[7] ..... D05B 21/00

(52) U.S. Cl. ..... 112/470.16; 112/475.06; 223/38

(58) Field of Search ..... 112/470.16, 470.07, 112/470.18, 141, 147, 475.06, 475.08, 475.09; 223/37, 38

(56) References Cited

U.S. PATENT DOCUMENTS

| | | | | | |
|---|---|---|---|---|---|
| 4,869,185 | A | * | 9/1989 | Scholl et al. | 112/147 |
| 5,014,633 | A | * | 5/1991 | Murata | 112/470.07 |
| 5,555,835 | A | * | 9/1996 | Campolucci | 112/475.07 |
| 5,584,258 | A | * | 12/1996 | Del Castillo | 112/470.07 |
| 5,611,468 | A | * | 3/1997 | Schulze et al. | 112/470.07 X |

FOREIGN PATENT DOCUMENTS

| | | | | |
|---|---|---|---|---|
| DE | 41 13 131 C1 | * | 7/1992 | 112/470.07 |
| DE | 42 34 968 C1 | * | 12/1993 | 112/470.07 |
| DE | 197 56 350 C1 | * | 2/1999 | 112/470.07 |

* cited by examiner

*Primary Examiner*—Peter Nerbun
(74) *Attorney, Agent, or Firm*—McGlew and Tuttle, P.C.

(57) ABSTRACT

To sew on pockets to be folded over or prefolded pockets as desired, a sewing unit can be equipped or retrofitted in a simple manner with holding and folding means (28, 31) for the pockets to be folded over or with support and holding means (33, 34; 36, 37) for prefolded pockets.

15 Claims, 2 Drawing Sheets

SEWING UNIT FOR SEWING FOLDED OR PRE-FOLDED POCKETS

FIELD OF THE INVENTION

The present invention pertains to a sewing unit according for sewing pockets folded over in the edge area on a fabric part with a said sewing machine, a guide for moving a fabric holder from a feeding area to a sewing machine, a device for raising and lowering the fabric holder, a first bracket, which can be moved by a drive device at least between a raised position and a lowered position, a second bracket, which can be moved by a drive device at least between a raised position and a lowered position as well as between a pushed-forward position and a withdrawn position, and a control unit with memory.

BACKGROUND OF THE INVENTION

Two fundamentally different processes for sewing pockets folded over in the edge area on large-large-area fabric parts have been known, which may be, e.g., shirt front parts or jeans. In one process, which is known, e.g., from German Auslegeschrift DE-AS 1 168 230 (U.S. Pat. No. 3,216,383), prefolded pockets are placed on the fabric part and are subsequently sewn on. A clamp, which receives the pocket and is displaceably arranged on a carrying frame for the fabric part, is used to accurately place the pocket on the fabric part. The prefolding of the pockets is performed here on folding presses which are equipped with replaceable folding tools adapted to the particular shape and size of the pocket. After folding over, the fold of the edge areas is fixed by pressing it under the effect of heat. Since even irregularly folded areas are now pressed flat to the extent that they will not be particularly disturbing thereafter, the folding device of folded presses may have a comparatively simple design.

In another process, known, e.g., from German Utility Model DE-GM 1 964 067 (U.S. Pat. No. 3,528,378) or DE-C1 41 13 131 (U.S. Pat. No. 5,211,320), flat pocket cuts are folded over in the edge area by means of the folding device on a sewing unit having a sewing machine and a folding device and then taken over by the program-controlled fabric holder of the sewing unit and fed to the sewing machine. Such folding devices comprise a pressure plate arranged on a first bracket and a plurality of folding slides, which are arranged on a frame likewise arranged on the first bracket and can be moved to and fro by means of compressed air cylinders between an inoperative position and a folding position. The first bracket can be moved into three different height positions, namely, an upper inoperative position, a folding position located under it, and a lower transfer position. A pocket support plate is arranged on a second bracket. The second bracket can be moved essentially into two different height positions, namely, an upper insertion and folding position corresponding to the middle position of the first bracket and a lower pressing position for the folded-over edge sections of the pocket located on the pocket support plate, which position corresponds to the lower position of the first bracket. If necessary, the pocket support plate can also be moved into a third height position, in which it floats just above the fabric part, for the accurate alignment of patterned pockets and fabric parts according to the pattern.

Since the folded-over pockets are taken over by the fabric holder without an intermediate pressing on of the edge areas in this process, the folding-over operation must be carried out particularly accurately, but this contributes to an especially accurate and clean work result being achieved. The folding devices used or integrated in sewing units are therefore comparatively more complicated and therefore more expensive that the folding devices used on folding presses.

Since the folding devices used to fold over pockets generally comprise a larger number of components adapted to the particular shape and size of the pocket, correspondingly adapted, different folding devices must be kept ready for different pocket shapes and sizes and replaced as needed. In the case of frequently changing pocket shapes and pocket sizes, this leads to a correspondingly great effort in sewing units with integrated folding device.

SUMMARY AND OBJECTS OF THE INVENTION

The basic object of the present invention is to make it possible to change the pocket shapes and pocket sizes at a low effort during the sewing on of pockets folded over in the edge area.

According to the invention, a sewing unit is provided for sewing pockets folded over in the edge area on a fabric part. The sewing unit includes a sewing machine, a fabric holder, and a guide for moving a fabric holder from a feeding area to the sewing machine. A fabric holder movement arrangement is provided with a device for raising and lowering the fabric holder, a first bracket, which can be moved by a first drive device at least between a raised position and a lowered position and a bracket, which can be moved by a second drive device at least between a raised position and a lowered position as well as between a pushed-forward position and a withdrawn position. A control unit is provided with a memory device for carrying out a programmed function of the different drive devices with integrated stop and intermediate start functions. A holder is provided formed by one of a pocket support plate associated with a folding device for the processing of pockets to be folded over and by an insertion frame in combination with a pocket pressure plate for the processing of prefolded pockets, said holder being provided at the brackets. A plurality of control programs associated with various processing variants are stored in the memory means of the control device and can be called up as needed. The processing varianets may be coordinated with the holder employed.

Due to the measure of arranging, as is known, either holding and folding means for carrying out a folding-over operation or support and holding means for, e.g., pockets prefolded on a folding press at the two movable brackets of a sewing unit or of providing such support and holding means directly at the fabric holder and of calling up the correct control program from the data memory of the control, the sewing unit can be changed over from one mode of operation to the other, i.e., from the processing of pockets to be folded over to the processing of prefolded pockets, without an appreciable effort. It is thus made possible that the expensive holding and folding means used for folding over on the sewing unit continue to be reserved for the processing of pockets generated in large numbers and/or for obtaining an especially accurate folding result, whereas in the case of frequent changeover between pockets produced in small lot sizes, the pockets are processed in the prefolded state, which will then make possible the use of the less expensive folding devices for the folding presses and of the simple support and holding means at the sewing unit.

Since pocket presses are already available in many, especially smaller sewing shops and the comparatively simple folding devices used for this purpose as well as the likewise simple support and holding means (holder) for the prefolded pockets can be manufactured without an appreciable effort in the sewing shops or workshops located close by and thus on the site, it is thus possible to respond to fashion effects in a short time by processing prefolded pockets.

Accurate mutual alignment of the pocket and the fabric part can be achieved during the processing of prefolded pockets according to a first embodiment by the insertion frame being lowered onto the fabric part with a weak force only or being held in a suspended position just above it, as a result of which the fabric part continues to be displaceable, and, furthermore, by the insertion frame either being designed as a thin-walled frame or being manufactured from a transparent material to achieve the most unhindered observability possible of the relative positions of the pocket and the fabric part.

Particularly narrow seam distances from the edge of the pocket can be obtained during the processing of prefolded pockets according to a second embodiment. This is due to the fact that the holding flap used to hold down the pocket inserted into the recess of the fabric holder does not have to hold the pocket at its edge from the outside, as in the other two processing processes and, as a consequence of this, it does not have a sewing slot corresponding to the shape and width of the seam, but it holds the pocket at a spaced location from its edge. This makes it possible to form the seam or, in the case of a double seam, the outer seam in cooperation with a holding-down foot moving up and down with the rhythm of sewing at the shortest possible distance from the free edge of the pocket.

The above-mentioned holding flap at the fabric holder can be brought into the closed or hold-down position during the sewing operation either by a floating foot arranged at the pressure bar of the sewing machine or, according to claim 6, by an actuating means, e.g., a compressed air cylinder.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
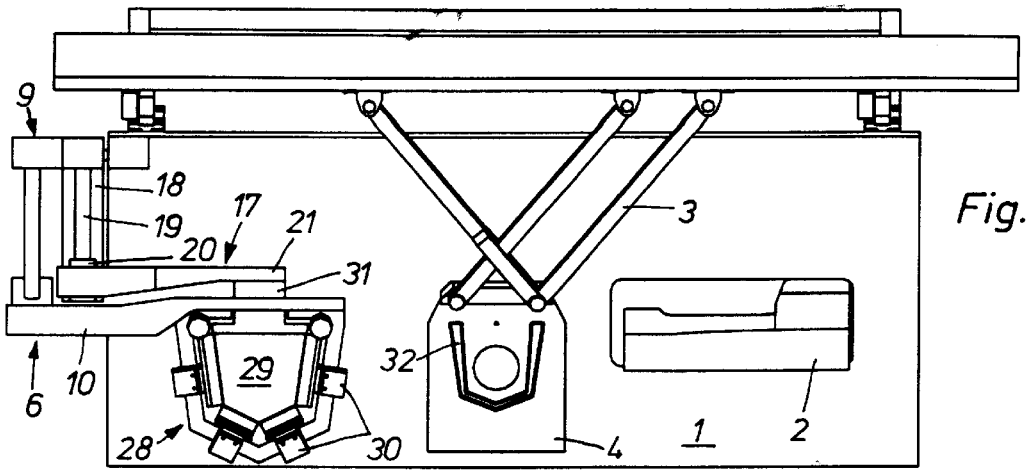
FIG. 1 is a top view of a sewing unit with integrated folding device.

Referring to the drawings in particular, the sewing unit used to sew on folded-over pockets on a fabric part, which is shown in the various figures, corresponds to the sewing unit described in detail in DE 42 34 968 C1 (U.S. Pat. No. 5,400,728). Therefore, it likewise has a fabric support plate 1, a sewing machine 2 and a guide means 3 for a fabric holder 4 or 4*a*. A device 5 for raising and lowering the respective fabric holder 4 and 4*a* is associated with the guide device 3.

The sewing unit has a first bracket 6, which is formed by an angle lever 9 having two arms 7, 8 and a carrier rod 10, which is fastened to the longer arm 8 and extends at right angles thereto. The piston rod 11 of a compressed air cylinder 13 arranged at a stationary bracket 12 is articulated to the short arm 7. The carrier rod 10 can be moved between a raised position and a lowered position by means of the compressed air cylinder 13. A compressed air cylinder 14, whose longitudinal axis extends essentially at right angles to the plane of the obliquely extending fabric support plate 1, is fastened to the frame of the sewing unit beneath the arm 8 in a manner not specifically shown. In the withdrawn state of the piston rod 15, the free end of the piston rod is located under the lower pivoted position of the arm 8 and it therefore does not affect the position of that arm. With the piston rod 15 extended, the free end of the piston rod extends into the path of movement of the arm 8 and causes this arm and consequently the carrier rod 10 to be held in a position that is just above the above-mentioned lowered position. The compressed air cylinders 13, 14 together form a first drive device 16.

The sewing unit has a second bracket 17. It contains a hollow arm 18, which is pivotable around the same axis as the angle lever 9. A guide rail 19, which accommodates a carriage 20, is fastened to the arm 18. A carrier rod 21, which extends at right angles to the arm 18, is fastened to the carriage 20. A compressed air cylinder 22, whose longitudinal axis extends essentially at right angles to the plane of the obliquely extending fabric support plate 1, is fastened to the frame of the sewing unit in a manner not specifically shown. The carrier rod 21 can be moved between a raised position and a lowered position by means of the compressed air cylinder 22, whose piston rod 23 cooperates with the underside of the arm 18.

A belt cylinder 24, which is known per se and is therefore shown in broken lines by its piston only and has a carriage-like carrier 25 movable along on the underside of the arm 18, is arranged within the arm 18 as a linear drive unit. The carrier 25 is rigidly coupled to the carriage 20 via a connecting rod 26. The carrier rod 21 can be moved by means of the belt cylinder 24 between a pushed-forward position and a withdrawn position. The compressed air cylinder 22 and the belt cylinder 24 together form a second drive device 27.

The above-described general design of the sewing unit is the same in all three exemplary embodiments. The differences between the three exemplary embodiments will be explained below.

Exemplary Embodiment 1

A folding device 28, which is known from the state of the art, e.g., from DE 41 13 131 C1 (U.S. Pat. No. 5,211,320) and has essentially a pressure plate 29 and a plurality of folding slides 30, is used to fold over the edge sections of pockets in the known manner. The folding device is detachably fastened to the carrier rod 10 of the first bracket 6 in this exemplary embodiment, which is shown in FIGS. 1 and 4.

A flat pocket support plate 31 is detachably fastened to the carrier rod 21 of the second bracket 17. A sewing slot 32 corresponding to the desired seam shape and seam width is provided in the fabric holder 4.

Figure 4:
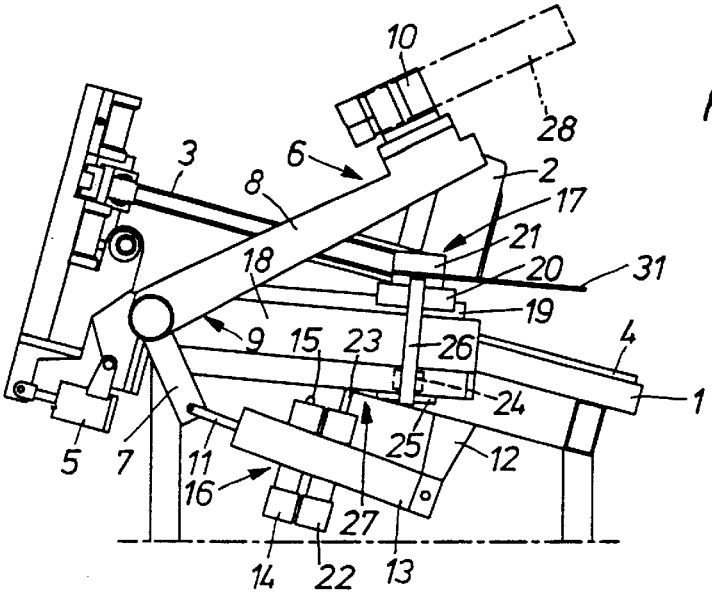
FIG. 4 is a side view of the sewing unit from FIG. 1.

In FIG. 4, the folding device 28 and the pocket support plate 31 are shown in their respective starting positions, i.e., the folding device 28 is in its inoperative position, which corresponds to the upper pivoted position of the arm 8 with the carrier rod 10, and the pocket support plate 31 is in the insertion and folding position, the arm 18 assuming the upper pivoted position and the carrier rod 21 being in the pushed-forward position.

The corresponding control program is selected from a memory of the machine control in the known manner, which is therefore not described in greater detail, for carrying out a complete work cycle, which comprises essentially the folding over of a pocket placed on the pocket support plate 31, the take-over of the folded pocket by the fabric holder 4, and the sewing of the pocket on a fabric part.

The function is as follows:

1. The fabric part is positioned manually on the fabric support plate 1 under the pocket support plate 31.
2. The pocket is positioned manually on the pocket support plate 31.
3. The processing program is started.
4. The folding device 28 is lowered into the folding position, while the pressure plate 29 comes to lie on the pocket and presses it against the pocket support plate 31.
5. The folding slides 30 are moved into the folding position, as a result of which they fold over the edge area of the pocket projecting over the edge of the pocket support plate 31.
6. The folding device 28 and the pocket support plate 31 are moved into the lower position, as a result of which the pocket support plate 31 presses the folded-over edge sections of the pocket onto the fabric part.
7. The folding slides 30 are returned to the inoperative position.
8. The folding device 28 is raised into the inoperative position.
9. The fabric holder 4 is moved in the raised position between the folding device 28 and the pocket support plate 31.
10. The fabric holder 4 is lowered onto the pocket.
11. The pocket support plate 31 is withdrawn into the inoperative position and pivoted upward.
12. The fabric holder 4 is moved with the fabric part and the pocket lying thereon to the sewing machine 2.
13. The pocket is sewn onto the fabric part.
14. The fabric holder 4 is moved into the unloading position and pivoted upward to release the sewn workpiece.
15. The pocket support plate 31 is pushed forward into the starting position.

The work cycle then ends.

Exemplary Embodiment 2

Figure 2:
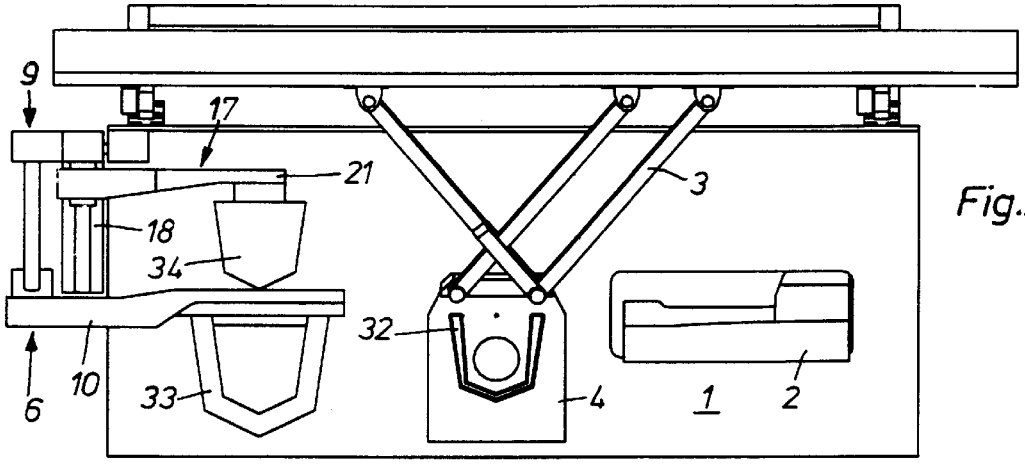
FIG. 2 is a top view of a sewing unit with an insertion frame for prefolded pockets.
Figure 5:
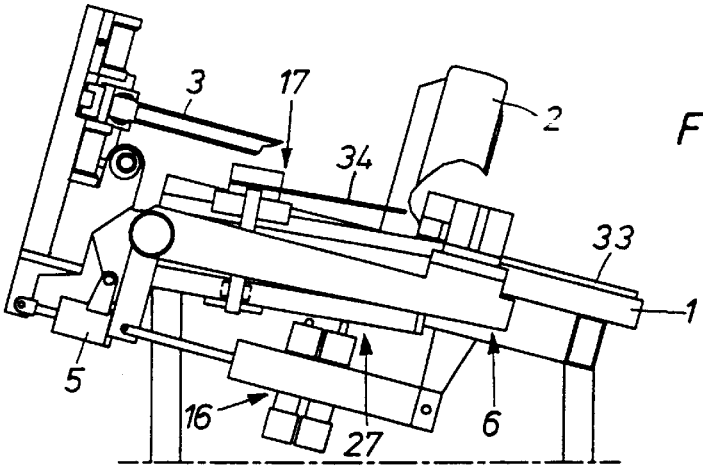
FIG. 5 is a side view of the sewing unit from FIG. 2.

An insertion frame 33 for prefolded pockets is detachably fastened to the carrier rod 10 of the first bracket 6 in this exemplary embodiment, which is shown in FIGS. 2 and 5. A flat pocket pressure plate 34 is fastened to the carrier rod 21 of the second bracket 17.

If the pockets to be folded are smaller than the prefolded pockets in the case of a changeover from the processing of pockets to be folded over to the processing of prefolded pockets or vice versa, the pocket support plate 31 used in conjunction with the folding device 28 can also be used as a pocket pressure plate 34 in conjunction with the insertion frame 33. This size limitation is due to the fact that when a pocket prefolded by means of the folding device 28 is taken over by the fabric holder 4, its pressure plate 29 grasps the pocket over its entire area and thus guarantees a reliable frictional engagement, so that there is no risk of distortion of the pocket during the withdrawal of the pocket support plate 31. By contrast, the conditions are different during the processing of a prefolded pocket positioned in an insertion frame 33 and fixed by a pocket pressure plate 34. In this case, the fabric holder 4 is not lowered onto the pocket, but onto the pocket pressure plate 34 during the takeover of the pocket. To prevent the pocket from now becoming distorted during the withdrawal of the pocket pressure plate 34, a pocket pressure plate 34 that is smaller than the pocket is used, so that an edge strip of the subjacent pocket, which strip can now be grasped by the fabric holder 4, will project.

A suitable control program is again selected for carrying out a complete work cycle, which comprises essentially the insertion of a prefolded pocket into the insertion frame 33, the takeover of the pocket by the fabric holder 4, and the sewing of the pocket onto a fabric part.

The function is as follows:

1. The fabric part is positioned manually on the fabric support plate 1 under the insertion frame 33 raised into the inoperative position and the pocket pressure plate 34, which is likewise raised into the inoperative position and withdrawn.
2. Start of the processing program.
3. The insertion frame 33 is lowered into the insertion position (this corresponds to FIG. 5).
4. Stop of the processing program.
5. The prefolded pocket is positioned manually in the insertion frame 33.
6. Restart of the processing program.
7. The pocket pressure plate 34 is pushed forward from the inoperative position and lowered onto the prefolded pocket.
8. The insertion frame 33 is raised into the inoperative position.
9. The fabric holder 4 is moved in the raised position between the insertion frame 33 and the pocket pressure plate 34.
10. The fabric holder 4 is lowered onto the pocket pressure plate 34 and the projecting edge strip of the prefolded pocket.
11. The pocket pressure plate 34 is withdrawn into the inoperative position and pivoted upward.
12. The fabric holder 4 is moved with the fabric part and the pocket lying thereon to the sewing machine 2.
13. The pocket is sewn onto the fabric part.
14. The fabric holder 4 is moved into the unloading position and pivoted upward to release the sewn workpiece.

The work cycle then ends.

Exemplary Embodiment 3

Figure 3:
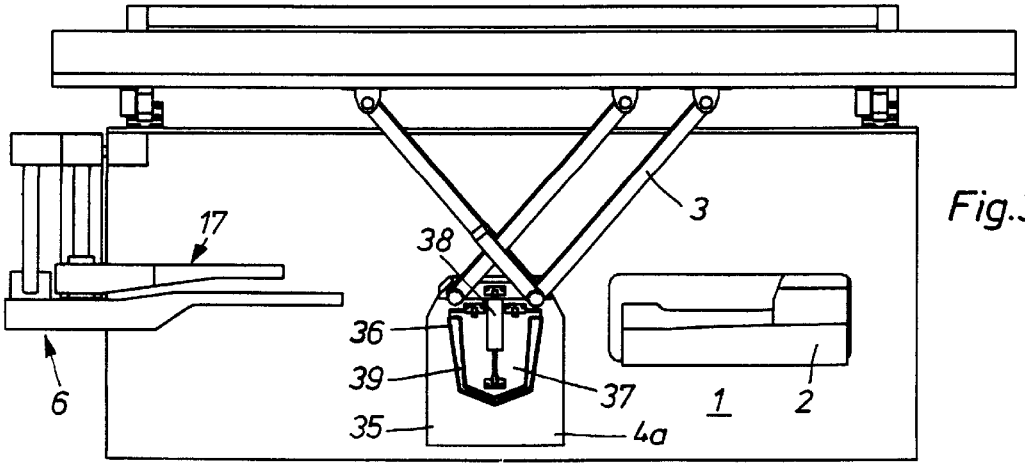
FIG. 3 is a top view of a sewing unit in which prefolded pockets can be placed directly into the fabric holder.
Figure 6:
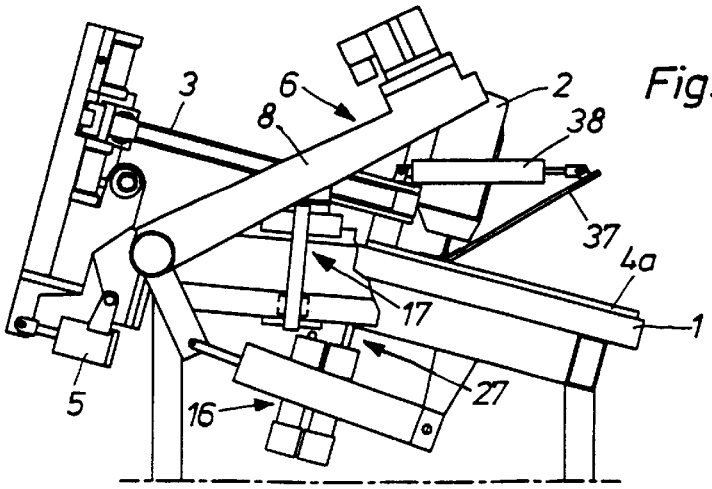
FIG. 6 is a side view of the sewing unit from FIG. 3.

The pressure plate 35 of the fabric holder **4*a* has a recess 36, which corresponds to the shape and the size of the prefolded pocket to be sewn on in this exemplary embodiment, which is shown in FIGS. 3 and 6. The recess 36 is used as a so-called nest for inserting a prefolded pocket here. A holding flap 37, which is smaller than the recess 36 and can be moved by means of a compressed air cylinder 38 between an open position and a closed position, is pivotably mounted on the pressure plate 35. A sewing slot 39 is provided between the edge of the holding flap 37 and the edge of the recess 36** in the closed position.

Since the prefolded pocket is positioned directly in the fabric holder **4*a* and directly on the fabric part in this exemplary embodiment and no folding tools or insertion aids that are to be arranged on the two brackets 6, 17 are thus needed, the brackets 6, 17** always remain in their inoperative position in this processing process.

A suitable control program is again selected for carrying out a complete work cycle, which comprises essentially the insertion of a prefolded pocket into the recess 36 of the fabric holder **4*a*** and the subsequent sewing of the pocket onto the fabric part.

The function is as follows:

1. The fabric part is positioned manually on the fabric support plate 1 under the raised fabric holder **4*a***.
2. Start of the processing program.

3. The fabric holder 4*a* is lowered onto the fabric part (this corresponds to FIG. 6).
4. Stop of the processing program.
5. The prefolded pocket is positioned in the recess 36 and now positioned on the fabric part with the holding flap 37 in the open position.
6. Restart of the processing program.
7. The holding flap 37 is pivoted into the closed position.
8. The fabric holder 4*a* is moved to the sewing machine 2 with the fabric part and the pocket lying thereon.
9. The pocket is sewn onto the fabric part.
10. The fabric holder 4*a* is moved into the unloading station and pivoted upward to release the sewn workpiece.
11. The holding flap 37 is pivoted into the open position. The work cycle then ends.

The loading or feeding position of the fabric holder 4*a* may coincide with its unloading position in this processing process. Since this position may be located at a closely spaced location from the sewing machine 2, short displacements of the fabric holder can, on the whole, be achieved in this case.

While specific embodiments of the invention have been shown and described in detail to illustrate the application of the principles of the invention, it will be understood that the invention may be embodied otherwise without departing from such principles.

What is claimed is:

1. A sewing unit for sewing pockets folded over in the edge area on a fabric part, the unit comprising:

a sewing machine;

a fabric holder;

a guide for moving the fabric holder from a feeding area to the sewing machine;

a device for raising and lowering the fabric holder;

a first drive device;

a first bracket, which can be moved by said first drive device at least between a raised position and a lowered position;

a second drive device a second bracket, which can be moved by said second drive device at least between a raised position and a lowered position as well as between a pushed-forward position and a withdrawn position;

a control unit with memory for carrying out a programmed function of the different drive devices with integrated stop and intermediate start functions;

a holder including one of a holder with folding device for the pockets arranged at the said brackets for processing pockets to be folded over and a support and holder for the pockets arranged at the said brackets or at the fabric holder for processing prefolded pockets; and a plurality of control programs associated with various processing variants stored in said memory of said control device to be called up as needed.

2. A sewing unit in accordance with claim 1, wherein:

for processing pockets to be folded over said folding device has a pressure plate and a plurality of folding slides, said folding device being arranged on said first bracket, wherein said first bracket can be moved into three different height positions, namely, an inoperative position, a folding position and a transfer position;

said pocket support plate is arranged on said second bracket, said second bracket being moveable into at least two height positions, namely, an insertion and folding position corresponding to the middle position of said first bracket, and a pressing position for the folded-over pocket edge sections, said pressing position corresponding to a lower position of said first bracket, said fabric holder can be moved in the raised position, after raising the first bracket into the inoperative position, to the pocket support plate and lowered onto the table, said pocket support plate can be pulled out of the area of the fabric holder, after lowering the fabric holder, and subsequently raised into an inoperative position, and said fabric holder with said pocket placed on the fabric part can be moved to the sewing machine, after the removal of the pocket support plate.

3. A sewing unit in accordance with claim 1, wherein: said second bracket is moveable into an aligning position, which is located just above the pressing position.

4. A sewing unit in accordance with claim 1, wherein for processing prefolded pockets, the insertion frame for the prefolded pockets is arranged on the first bracket, the first bracket being able to be moved into two different height positions, namely, into an inoperative position and an insertion position, the pocket pressure plate, whose dimensions are smaller than the dimensions of the prefolded pockets, is arranged on said second bracket, the second bracket being able to be moved into two different height positions, namely, into an inoperative position and a pressing position for the prefolded pockets, which corresponds to the insertion position of the first bracket, after raising the first bracket into the inoperative position, the fabric holder can be moved in the raised position to the pocket pressure plate and it can be lowered onto the edge area of the pocket projecting over the pocket pressure plate, after lowering the fabric holder, the pocket pressure plate can be pulled out of the area of the fabric holder and subsequently raised into an inoperative position, and after removing the pocket pressure plate, the fabric holder can be moved with the pocket placed on the fabric part to the sewing machine.

5. A sewing unit in accordance with claim 2, wherein when changing over from the processing of pockets to be folded over to the processing of prefolded pockets and vice versa, the pocket support plate as well as the pocket pressure plate can be used if the pockets to be folded over are smaller than the prefolded pockets.

6. A sewing unit in accordance with claim 4, wherein when changing over from the processing of pockets to be folded over to the processing of prefolded pockets and vice versa, the pocket support plate as well as the pocket pressure plate can be used if the pockets to be folded over are smaller than the prefolded pockets.

7. A sewing unit in accordance with claim 1, wherein for processing prefolded pockets said first and second brackets remain in the respective inoperative positions, a recess for receiving the prefolded pockets is contained in said fabric holder and a holding flap is mounted pivotably on said fabric holder for the pockets provided in said fabric holder and a feed point of said fabric holder can be set at a short distance from said sewing machine.

8. A sewing unit in accordance with claim 7, wherein said holding flap can be connected to an actuating device.

9. A sewing process for sewing pockets folded over in the edge area on a fabric part, the unit comprising:

providing a sewing unit including a sewing machine, a fabric holder, a guide for moving the fabric holder from a feeding area to the sewing machine, a device for raising and lowering the fabric holder, a first drive device, a first bracket, which can be moved by said first drive device at least between a raised position and a lowered position, a second drive device, a second bracket, which can be moved by said second drive device at least between a raised position and a lowered position as well as between a pushed-forward position and a withdrawn position and a control unit with memory for carrying out a programmed function of the different drive devices with integrated stop and intermediate start functions;

selecting a holder from a pocket folding over holder including a pocket support plate associated with a folding device, and a prefolded pocket holder including an insertion frame and a pocket pressure plate in; and choosing from a plurality of control programs associated with the various processing variants stored in the memory means of the control device based on said step of selecting to process pockets using the pocket folding over holder before sewing and to process pockets using the prefolded pocket holder before sewing.

10. A process in accordance with claim 9, further comprising:

folding over pocket parts using a folding device using a pressure plate and a plurality of folding slides, said folding device being arranged on said first bracket, wherein said first bracket can be moved into three different height positions, namely, an inoperative position, a folding position and a transfer position;

arranging said pocket support plate on said second bracket, said second bracket being moveable into at least two height positions, namely, an insertion and folding position corresponding to the middle position of said first bracket, and a pressing position for the folded-over pocket edge sections, said pressing position corresponding to a lower position of said first bracket, said fabric holder can be moved in the raised position, after raising the first bracket into the inoperative position, to the pocket support plate and lowered onto the table, said pocket support plate can be pulled out of the area of the fabric holder, after lowering the fabric holder, and subsequently raised into an inoperative position, and said fabric holder with said pocket placed on the fabric part can be moved to the sewing machine, after the removal of the pocket support plate.

11. A process in accordance with claim 9, wherein said second bracket is moveable into an aligning position, which is located just above the pressing position.

12. A process in accordance with claim 9, wherein: for processing prefolded pockets, the insertion frame for the prefolded pockets is arranged on the first bracket, the first bracket being able to be moved into two different height positions, namely, into an inoperative position and an insertion position, the pocket pressure plate, whose dimensions are smaller than the dimensions of the prefolded pockets, is arranged on said second bracket, the second bracket being able to be moved into two different height positions, namely, into an inoperative position and a pressing position for the prefolded pockets, which corresponds to the insertion position of the first bracket, after raising the first bracket into the inoperative position, the fabric holder can be moved in the raised position to the pocket pressure plate and it can be lowered onto the edge area of the pocket projecting over the pocket pressure plate, after lowering the fabric holder, the pocket pressure plate can be pulled out of the area of the fabric holder and subsequently raised into an inoperative position, and after removing the pocket pressure plate, the fabric holder can be moved with the pocket placed on the fabric part to the sewing machine.

13. A process in accordance with claim 12, wherein when changing over from the processing of pockets to be folded over to the processing of prefolded pockets and vice versa, the pocket support plate as well as the pocket pressure plate can be used if the pockets to be folded over are smaller than the prefolded pockets.

14. A process in accordance with claim 9, further comprising the steps of:

for processing prefolded pockets maintaining said first and second brackets in the respective inoperative positions;

providing a recess for receiving the prefolded pockets contained in said fabric holder;

mounting a holding flap pivotably on said fabric holder for the pockets provided in said fabric holder;

establishing a feed point of said fabric holder set at a short distance from said sewing machine.

15. A process in accordance with claim 14, wherein said holding flap is connected to an actuating device.

* * * * *